US005858281A

United States Patent [19]

Dellinger, Jr. et al.

[11] Patent Number: 5,858,281

[45] Date of Patent: Jan. 12, 1999

[54] TEXTILE TREATMENT PROCESSES AND COMPOSITIONS THEREFOR

[75] Inventors: Samuel G. Dellinger, Jr.; Robert V. Casciani, both of Charlotte, N.C.

[73] Assignee: Clariant Finance (BVI) Limited, Tortola, Virgin Islands (Br.)

[21] Appl. No.: 806,373

[22] Filed: Feb. 27, 1997

[51] Int. Cl.[6] ..... B01F 17/10; B01F 17/40; B01F 17/02; C11D 1/12

[52] U.S. Cl. ..... 252/353; 252/351; 510/357; 510/356

[58] Field of Search ..... 252/353, 351; 570/351, 356, 357; 8/582, 591, 613

[56] References Cited

U.S. PATENT DOCUMENTS

| | | | |
|---|---|---|---|
| 1,970,578 | 8/1934 | Scoeller et al. | 260/98 |
| 2,028,091 | 1/1936 | Jaeger | 260/106 |
| 3,847,543 | 11/1974 | Carroll | 8/127.6 |
| 3,922,462 | 11/1975 | Katz et al. | 428/290 |
| 5,512,211 | 4/1996 | McSwigan et al. | 252/353 |

*Primary Examiner*—Joseph D. Anthony
*Attorney, Agent, or Firm*—Thomas C. Doyle

[57] ABSTRACT

New compositions are provided which comprise a substituted phenoxypoly(ethyleneoxy)ethanol, particularly an ethoxylated alkylphenol, and a sulfosuccinate, particularly a dialkyl sulfosuccinate, and new processes are provided wherein said compositions are used to improve the ability of an aqueous liquid to wet a textile material.

13 Claims, No Drawings

TEXTILE TREATMENT PROCESSES AND COMPOSITIONS THEREFOR

This invention relates to improved processes for applying a substance to a textile substrate from an aqueous medium and to compositions which are useful in such processes.

BACKGROUND OF THE INVENTION

In the dyeing or printing of a textile substrate wherein a dyestuff is applied to the substrate from an aqueous medium it is desirable to achieve good wetting of the substrate surface with the dye-containing aqueous medium. Some textile materials are more resistant to wetting than others. Also, some dyeing and printing processes, particularly continuous processes, are carried out in a manner such that the substrate is not in contact with the dye-containing aqueous medium long enough for sufficient wetting to take place without the help of a wetting agent. Accordingly, it is common practice for dyers and printers to employ a wetting agent in an aqueous dyeing liquor or printing paste to reduce the time required for proper wetting to occur. The foregoing also holds true for processes wherein substances other than dyes, e.g. optical brightening agents or reserving agents, are applied to textile substrates from aqueous media. Among the wetting agents which have been used are dioctyl sodium sulfosuccinate, 2-ethylhexyl sulfate and ethoxylated alcohols and alkylphenols. However, there has continued to be a need for improvement in the wetting of textile substrates, especially in continuous textile treatment processes and more especially in such processes wherein the material being treated is one which is difficult to wet.

It is, therefore, an object of this invention to provide a textile treatment process which comprises contacting a textile substrate with an aqueous medium wherein improved wetting of the substrate with the aqueous medium is achieved.

It is another object of this invention to provide a composition which improves the ability of an aqueous medium to wet a textile substrate.

SUMMARY OF THE INVENTION

We have discovered that improved wetting of a textile material with an aqueous liquid can be achieved when the aqueous liquid contains both a sulfosuccinate and a substituted phenoxypoly(ethyleneoxy)ethanol.

We have also discovered a composition which improves the ability of an aqueous liquid to wet the textile substrate, said composition comprising a sulfosuccinate and a substituted phenoxypoly(ethyleneoxy)ethanol.

The process and composition of this invention are particularly advantageous when used in a textile treatment wherein the aqueous liquid is one which contains a substance which is to be applied to a textile substrate, such as a dyebath or printing paste.

DETAILED DESCRIPTION OF THE INVENTION

The present invention provides a process for applying a substance to a textile substrate which comprises contacting the substrate with an aqueous liquid containing (a) the substance to be applied to the substrate, (b) a compound of formula (I)

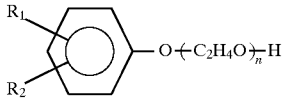

(I)

or mixture thereof, wherein $R_1$ is an aliphatic or alicyclic hydrocarbon group containing 6 to 12 carbon atoms, $R_2$ is hydrogen or an aliphatic or alicyclic hydrocarbon group containing up to 12 carbon atoms and n is a number such that the group $-(C_2H_4O)_n-$ comprises 35 to 90% of the molecular weight of each compound of formula (I), and (c) a compound of formula (II)

$$\mathrm{ROOC{-}CH_2{-}\underset{\underset{SO_3X}{|}}{CH}{-}COOR} \qquad \text{(II)}$$

or mixture thereof, wherein each R is, independently, an aliphatic or alicyclic hydrocarbon group containing 5 to 13 carbon atoms and X is hydrogen, ammonium or an alkali metal cation.

Preferred compounds of formula (I) are those which have an HLB (hydrophilic-lipophilic balance) value in the range 8 to 18, more preferably 10 to 18, most preferably 11 to 16.

In the compounds of formula (I), $R_1$ is preferably an alkyl or cycloalkyl group. More preferably, it is a linear or branched alkyl group. Most preferably, it is alkyl of 7 to 10 carbon atoms, especially octyl or nonyl.

$R_2$ is preferably hydrogen or an alkyl or cycloalkyl group, more preferably hydrogen or an alkyl group which may be different from but is preferably the same as $R_1$. Most preferably, $R_2$ is hydrogen.

When $R_2$ is other than hydrogen, $R_1$ and $R_2$ are preferably in the 2- and 4-positions on the phenylene ring relative to the $-O-(C_2H_4O)_n-H$ group.

When $R_2$ is hydrogen, $R_1$ is preferably in the 2- or 4-position on the phenylene ring, with the 4-position usually predominating.

Preferably, n is a number (typically an average number when a mixture of compounds of formula (I) is present) such that the group $-(C_2H_4O)_n-$ comprises 45 to 90%, especially 50 to 87%, of the total molecular weight of the compound of formula (I).

Of particular interest are those compounds of formula (I) wherein $R_1$ is octyl or nonyl, $R_2$ is hydrogen and n is a number from 5 to 30, whereby the group $-(C_2H_4O)_n-$ comprises about 50 to 87% of the total molecular weight of the compound.

The most preferred compounds of formula (I) are the compounds wherein $R_1$ is octyl, $R_2$ is hydrogen and n is 5 to 9 and especially the compound wherein $R_1$ is nonyl, $R_2$ is hydrogen and n is 9.

In the compounds of formula (II), each R, independently, is preferably an aliphatic hydrocarbon group, more preferably an alkyl group, especially $C_{7-9}$ alkyl.

Preferably, both R's are the same.

X is preferably an alkali metal cation, more preferably potassium or, especially, sodium.

The most preferred compound of formula (II) is dioctyl sodium sulfosuccinate.

Preferably, the compounds of formula (I) and formula (II), respectively, are present in the aqueous medium in a weight ratio in the range 1:1 to 15:1, more preferably 3:1 to 12:1, most preferably 4.5:1 to 9:1.

The compounds of formulae (I) and (II) should be present in the aqueous liquid in a total amount which is effective to enhance the ability of the aqueous liquid, particularly such aqueous liquid which contains a substance to be applied to a textile substrate, to wet the substrate. As will be obvious to a person skilled in the art, this total amount will vary somewhat, depending on the degree of hydrophobicity of the particular substrate and the length of time in which the desired wetting of the substrate must be achieved. Preferably, for an aqueous liquor, such as a dyebath or optical brightener bath, the total amount of compounds of formulae (I) and (II) will be at least 0.5 gram, more preferably at least 1 gram, most preferably at least 3 grams per liter of the total aqueous liquor, e.g. the complete dyebath. Amounts in excess of 30 g/l usually do not provide any further improvement. The total amount of compounds of formulae (I) and (II) should be kept below that which will cause objectionable foaming under the particular physical conditions to which the aqueous liquor is subjected during the textile treatment process and is preferably no greater than 30 g/l, more preferably no greater than 20 g/l and most preferably no greater than 15 g/l, based on the total volume of the aqueous liquor. Amounts in the range 5 to 12 g/l have worked very well. For an aqueous paste, such as a printing paste, where it is often preferred to measure the amounts of the components in grams per kilogram, the total amount of compounds of formulae (I) and (II) is preferably at least 0.5, more preferably at least 1, most preferably at least 3 g/kg and preferably no greater than 30 g/kg, more preferably no greater than 20 g/kg and most preferably no greater than 15 g/kg, based on the total weight of the paste.

The compounds of formulae (I) and (II) may be added to the aqueous liquid separately or, preferably, in admixture with one another.

When a compound of formula (I) which is sufficiently water-soluble is added separately from a compound of formula (II), it can be added, as is, directly to the aqueous liquid (i.e. the main body of aqueous liquid with which the textile material is to be contacted) or it can be premixed with a separate quantity of water to form an aqueous concentrate, preferably containing at least 20% of the compound of formula (I), by weight, which concentrate is then added to the aqueous liquid. Some such aqueous concentrates are commercially available, for example as IGEPAL CA-887 and IGEPAL CO-887 nonionic surfactants from Rhone-Poulenc, which are 70% solutions of compounds of formula (I) in which n is 30, $R_2$ is hydrogen and $R_1$ is octyl and nonyl, respectively, in water. Use of an aqueous concentrate is suitable regardless of whether it comprises a solution of a compound of formula (I) which is normally a solid or an aqueous mixture of a compound of formula (I) which is a liquid at normal temperatures.

When a compound of formula (I) which is not sufficiently water-soluble is added to the aqueous liquid separately from the compound of formula (II), it is added directly, but preferably only when the aqueous liquid is maintained under continuous agitation or contains one or more other compounds which will enhance the solubility of the compound of formula (I) in the aqueous liquid.

By "sufficiently water-soluble" as used herein is generally meant that the compound will dissolve in water to the extent required to produce a solution of a desired concentration without excessive heating, agitation and/or consumption of time. This will, of course, be somewhat subjective, depending on the particular circumstances, but can readily be determined by a person skilled in the art. Preferably, a compound which is "sufficiently water-soluble" is one which readily dissolves in water to the extent required at a temperature of 70° C. or less.

Compounds of formula (II) are generally solids at normal temperatures. When such a compound, e.g. dioctyl sodium sulfosuccinate, is added to the aqueous liquid separately from a compound of formula (I), it is preferably added in a liquified state in the form of a concentrated solution such as can be produced by mixing such compound of formula (II) in a sufficient amount of a mixture of water and other co-solvents such as propylene glycol and/or one or more alcohols, such as ethanol or 2-ethylhexanol. Preferably, such a concentrated solution contains at least 20%, more preferably at least 40% of the compound of formula (II), by weight. Examples of such concentrated solutions are a mixture comprising 70% dioctyl sodium sulfosuccinate, 16% water and 14% propylene glycol, by weight, and a mixture comprising 65% dioctyl sodium sulfosuccinate, 1–2% ethanol, 4-6% 2-ethylhexanol and the balance water, which mixtures are also commercially available as AEROSOL OT-70PG and AEROSOL TO-TG surfactants, respectively, from CYTEC Industries.

When the compounds of formulae (I) and (II) are added to the aqueous liquid in admixture with one another, such mixtures can be formed by various methods. According to one method, a compound of formula (II) is dissolved directly in a compound of formula (I) which is a liquid at normal temperatures. This is a preferred method when the compound of formula (I) is not sufficiently water-soluble by itself According to another method, a compound of formula (II) is dissolved in an aqueous concentrate of a sufficiently water-soluble compound of formula (I) as described above. According to other methods, a compound of formula (II) in a liquified state, as described above, is mixed with a compound of formula (I) which is a sufficiently water-soluble liquid or with an aqueous concentrate of a sufficiently water-soluble compound of formula (I) as described above.

Mixing is preferably effected at elevated temperatures, e.g. in the range 35° to 70° C., more preferably 45° to 60° C.

The process of this invention can be used in the treatment of any fibrous textile material for which improved wetting is desired, including relatively easily wettable materials such as cotton and wool. However, it is especially advantageous for the treatment of textile materials which are more resistant to wetting, such as polyolefins, synthetic polyamides, e.g. nylon 6 and nylon 6/6, polyesters, e.g. polyethylene terephthalate, and polyacrylonitrile. Of particular interest are polypropylene, nylon and polyester.

The textile material may be in any form, e.g. thread, yarn, knitted goods, woven goods, fleece or tufted or cut pile carpeting. Preferably, it is in a form which is suitable for treatment in a continuous process. Of particular interest are tapes (e.g. as used for trim in the textile industry) and carpeting.

The substance which is preferably in the aqueous liquid with the compounds of formulae (I) and (II) and which is to be applied to the textile material may be any substance which is suitable for application from an aqueous medium to the particular textile material being treated and which is compatible with the compounds of formulae (I) and (II). Substances which come to mind include dyes, optical brightening agents and reserving agents, including direct or sulfur dyes for cellulosic materials, acid dyes for wool and nylon, pre-metalized dyes for cationic-dyeable nylon, and disperse dyes for polyester and polypropylene, which dyes are well known in the art and many of which are described in the Colour Index, and anionic and non-ionic optical brightening agents, such as those described in U.S. Pat. Nos. 3,970,647; 4,025,507; 4,108,887 and 4,252,604, the disclosures of which are incorporated herein by reference. Of particular interest are the dyeing of polyester or polypropylene with disperse dyes and, especially, the dyeing and printing of nylon with acid dyes.

The process of this invention can be carried out in a manner which is conventional for applying a particular substance to a particular textile substrate from an aqueous medium, except for the presence in the aqueous medium of the compounds of formulae (I) and (II). It will be apparent to a person skilled in the art which application method is appropriate, depending on the substrate and the substance to be applied thereto.

Excellent results have been obtained when the compounds of formulae (I) and (II) have been used without any other wetting agent.

The improved wetting achieved by employing a combination of compounds of formulae (I) and (II) is particularly advantageous in continuous processes.

A preferred dyeing or brightening process is the pad-steam process wherein the textile substrate is drawn through an aqueous bath containing a suitable dye or optical brightening agent along with the compounds of formulae (I) and (II) and any conventional adjuvants which may be necessary or desirable, such as an acid to give the appropriate pH, then between squeeze rolls set at a pressure to achieve the desired pick-up of dye- or brightener-containing liquor for the particular type of substrate, e.g. 30 to 60% based on the weight of the substrate, and then through a steamer to fix the dye or optical brightening agent on the substrate. The temperature and pH of the bath, the concentration of dye or optical brightening agent therein and the duration of the steaming will depend on the particular textile material and dye or brightener employed and the result, e.g. depth of shade, desired and can be readily determined by a person of ordinary skill in the art. After the steaming, the dyed or brightened substrate can be washed, rinsed and dried in conventional manner. In dyeing nylon with acid dyes it is preferred, but not essential, to steam the substrate directly after padding, whereas an intermediate drying step is preferred when dyeing a substrate with a disperse dye.

For the continuous dyeing of carpet an aqueous dye liquor containing the compounds of formulae (I) and (II) can be applied at ambient temperature from an applicator to a length of carpet continuously passing beneath said applicator to give a wet pick-up of 150 to 450%, by weight, followed by steaming of the thus-treated carpet for a sufficient time to fix the dye, e.g. 6 to 8 minutes, and rinsing.

Continuous printing can be carried out in a manner which is conventional for printing a particular substrate, except that the printing paste contains, as a wetting agent, an effective combined amount of compounds of formula (I) and (II) as described above. Suitable printing methods include flat bed, rotary and screen printing. It is often advantageous to include an effective amount of a defoaming agent, such as 2-ethylhexanol or a silicone compound. Instead of containing a dye, the printing paste may contain a reserving agent, such as a triazine derivative in aqueous dispersion sold by Clariant Corporation under the trademark SANDOSPACE S, whereby selected areas of the substrate are rendered non-substantive or less substantive to a dye which is subsequently applied by exhaust dyeing and a space dyeing effect is obtained.

The present invention also provides compositions comprising a mixture of compounds of formulae (I) and (II) described above.

With respect to the compositions of this invention, the same preferences apply with respect to the compounds of formulae (I) and (II), e.g. for R, $R_1$, $R_2$, n and X, and their weight ratios as are stated above in the description of the process.

A composition of this invention may be in the form of a textile treatment composition, e.g. a dyebath or printing paste as described above. Preferably, it is in the form of a premixed composition, as described above, which is suitable for mixing with an aqueous liquid to form a composition for use in treating a textile material and which has a total content of compounds of formulae (I) and (II) in the range 20 to 100%, more preferably 35 to 100%, by weight.

The compositions of this invention can be produced according to the methods described above for adding compounds of formulae (I) and (II) to an aqueous liquid or for mixing them together prior to adding them to an aqueous liquid with which a textile substrate is to be contacted.

Compounds of formula (I) can be produced by well known methods for polyoxyethylating a suitable substituted phenol, e.g. by condensation under suitable conditions of heat and pressure using an alkaline catalyst, such as sodium hydroxide or potassium hydroxide, and a sufficient amount of ethylene oxide to introduce the desired weight percent of oxyethylene units in a manner analogous to that disclosed in U.S. Pat. Nos. 1,970,578 and 2,774,709, the disclosures of which, particularly column 2, lines 28–44 and Examples 1–3 of the latter, are incorporated herein by reference. Suitable substituted phenols, can be produced by methods well known in the art for introducing one or more substituents onto the phenol molecule. For example, alkyl phenols can be produced by warming a mixture of phenol and the appropriate alcohol or olefin, such as isomers of octene or nonene, in the presence of sulfuric acid. Other substituted phenols can be made in an analogous manner.

Compounds of formula (I) are also commercially available as IGEPAL CO and IGEPAL CA oxyethylated nonylphenol and octylphenol nonionic surfactants, respectively, from Rhone-Poulenc.

Compounds of formula (II) are also commercially available. For example, AEROSOL TO brand of dioctyl sodium sulfosuccinate surfactants can be obtained from CYTEC Industries. Alternatively, this compound and other compounds of formula (II) can be produced by the processes described in U.S. Pat. No. 2,028,091, the disclosure of which, particularly page 1, second column, lines 32–47 and the examples, especially Examples 2–6, is incorporated herein by reference.

The compositions of this invention are useful for improving the wetting ability of aqueous dyebaths and printing pastes and other aqueous textile treatment liquors and can be used to provide the compounds of formulae (I) and (II) for the processes described above.

The compositions of the invention, when used in quantities sufficient to provide a total combined amount of compounds of formulae (I) and (II) as called for above, provide unexpectedly improved continuous dyeing and printing results as compared with compound(s) of formula (I) alone or compound(s) of formula (II) alone in an amount equal to said total combined amount.

In the following examples, which illustrate this invention, all parts and percentages are by weight, unless otherwise stated, and all temperatures are in degrees Celsius.

EXAMPLE 1 a) To 82.5 parts of a solution comprising 70% of a compound of formula (I), in which $R_1$ is 4-octyl, $R_2$ is hydrogen and n is 30, (87% ethylene oxide; HLB 17.4) and 30% water at 50° is added, with stirring, 17.5 parts of a solution comprising 70% dioctyl sodium sulfosuccinate, 14% propylene glycol and 16% water. Stirring is continued until mixing is complete and the resulting solution is then cooled to room temperature.

b) NYLOSAN Navy N-RBL Conc. Powder, 125 dye (C.I. Acid Blue 125), the product of part (a) above, water and formic acid (80%) are mixed together in amounts sufficient to produce a dyebath containing 30 g/l of the dye and 10 g/l of the product of part (a) and having a pH of 2.5. The resulting dyebath is heated to 320. A length of narrow (1.0 cm.) woven nylon tape, as used for trim, is drawn through the heated dyebath and then between two squeeze rollers set at a pressure to achieve a pick-up of 45% dye liquor, based on the dry weight of the tape. The thus-treated tape is steamed at 100° for 3 minutes, rinsed with tap water, washed at 82° in water containing an effective amount of a suitable detergent, e.g. 3 g/l of a scouring detergent comprising ethoxylated tallow alkylamine, methylated N-alkyl propylene diamine ethoxylate, ethoxylated castor oil and sodium hexametaphosphate, thoroughly rinsed again with tap water and dried. The resulting dyeing of the tape is evaluated visually and is rated "+++++" on a 5-point scale from "+" for poor to "+++++" for excellent.

The same rating system is used in Examples 2 to 6.

EXAMPLE 2 a) To 82.5 parts of a compound of formula (I), in which $R_1$ is 4-octyl, $R_2$ is hydrogen and n is 9, (65% ethylene oxide; HLB 13) at 50° is added, with stirring, 17.5 parts of dioctyl sodium sulfosuccinate. Stirring is continued until dissolution of the sulfosuccinate is complete and the resulting solution is then cooled to room temperature.

b) The procedure of part (b) of Example 1 is repeated, except that the product of part (a) of this example is used instead of the product of part (a) of Example 1. The resulting dyeing of the tape is rated "+++++".

EXAMPLE 3 a) The procedure of part (a) of Example 2 is repeated, except that in the compound of formula (I) n is 5 (50% ethylene oxide; HLB 10.0).

b) The procedure of part (b) of Example 1 is repeated, except that the product of part (a) of this example is used instead of the product of part (a) of Example 1. The resulting dyeing is rated "+++++".

EXAMPLE 4 a) The procedure of part (a) of Example 3 is repeated, except that 90 parts of the compound of formula (I) and 10 parts of dioctyl sodium sulfosuccinate are employed.

b) The procedure of part (b) of Example 1 is repeated, except that the product of part (a) of this example is used in place of the product of part (a) of Example 1. The resulting dyeing is rated "+++++".

EXAMPLE 5 a) The procedure of part (a) of Example 3 is repeated, except that 93.75 parts of the compound of formula (I) and 6.25 parts of dioctyl sodium sulfosuccinate are employed.

b) The procedure of part (b) of Example 1 is repeated, except that the product of part (a) of this example is used in place of the product of part (a) of Example 1 . The resulting dyeing is rated "++++".

EXAMPLE 6 a) To 33 parts of a compound of formula (I) in which $R_1$ is 4-nonyl, $R_2$ is hydrogen and n is 9 (65% ethylene oxide; HLB 13.0) are added 57 parts of water and 10 parts of a mixture comprising 70% dioctyl sodium sulfosuccinate, 16% water and 14% propylene glycol. The mixture is stirred at 50° until dissolution is complete and the resulting solution is cooled to room temperature.

b) The procedure of part (b) of Example 1 is repeated, except that the product of part (a) of this example is used instead of the product of part (a) of Example 1. The resulting dyeing of the tape is rated "+++++".

EXAMPLE 7

One hundred twenty-five milliliters of water containing, as a dispersing agent, 0.25 g. of a 35% aqueous solution of an ammonium salt of a polymer produced by reacting sulfonated ditolyl ether, sulfonated diisopropylnaphthalene and formaldehyde are heated to 120° and 1.75 g. of FORON Black RD-RBS (Granules) disperse dye from Clariant Corporation are dispersed therein. Heating is discontinued and preparation of the dyebath is completed by the addition of 0.25 g. of 90% formic acid (to pH 3.6), 6.25 g. of the product of part (a) of Example 6, 1.5 g. of modified aromatic hydrocarbon disperse dye carrier (ARROCAR-933 from Arrow Engineering, Inc.) and sufficient water to bring the total volume to 250 ml.. The resulting disperse dyebath is applied to a sample of polyester pile carpeting to a wet pick-up of 400% and the thus-treated sample is steamed for 8 minutes at 100°. It is then rinsed with cold water followed by warm (49°) water followed by cold water and dried. A level dyeing with excellent color yield is obtained.

EXAMPLE 8

Example 7 is repeated with the following changes: 1) the product of part (a) of Example 6 is replaced with 2.5 g. of the product of part (a) of Example 3 prepared by mixing 82.5 parts of a compound of formula (I) in which $R_1$ is 4-octyl, $R_2$ is hydrogen and n is 5 with 17.5 parts of dioctyl sodium sulfosuccinate; 2) the carrier is omitted; and 3) the polyester pile carpeting is a "carrier-free" polyester. An excellent dyeing is obtained.

EXAMPLE 9

Forty grams of NYLOSAN Navy N-RLB Conc. Powder 125 acid dye are pasted with 50 g. of urea and 30 g. of thiodiethylene glycol. To the resulting paste are added 245 g. of hot water and the resulting mixture is heated to boiling and then added to 600 g. of a 10% aqueous guar gum solution followed by addition of a mixture of 30 g. of ammonium sulfate and 5 g. of a product according to part (a) of any of Examples 1–6. The resulting printing paste is screen printed on woven nylon textile material, which is then dried at 93° and steamed for 20 minutes at 100° and atmospheric pressure in an autoclave. The printed textile material is then rinsed with cold water until the rinse water is clear, washed at 49° in water containing 1 g/l of sodium carbonate and 6 g/l of a detergent comprising ethoxylated tallow alkylamine, methylated N-alkyl propylene diamine ethoxylate and sodium hexametaphosphate, rinsed again and dried.

COMPARATIVE EXAMPLE A

Part (b) of Example 1 is repeated, except that the product of part (a) of that example is omitted from the dyebath. The resulting dyeing is characterized by undesired frosting and poor dye yield and is rated "+".

COMPARATIVE EXAMPLE B

Part (b) of Example 1 is repeated, except that 10 g/l of a mixture comprising 70% dioctyl sodium sulfosuccinate, 14% propylene glycol and 16% water is used instead of 10 g/l of the product of part (a) of that example. The resulting dyeing has dull color and lower dye yield than the dyeings obtained according to Examples 1–4 and is rated "+++".

COMPARATIVE EXAMPLE C

Part (b) of Example 3 is repeated, except that 10 g/l of the compound of formula (I) of that example is used instead of 10 g/l of the product of part (a) of that example. The resulting dyeing is characterized by poor dye yield and undesired frosting and is rated "++".

COMPARATIVE EXAMPLE D

Example 8 is repeated, except that the product of part (a) of Example 3 is replaced with 2.5 g. of the compound of formula (I) used in that example. The resulting dyeing is decidedly inferior to the dyeing of Example 8.

We claim:

1. A composition comprising a mixture of a compound of formula (I)

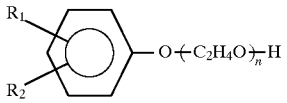

(I)

or mixture thereof, wherein $R_1$ is an aliphatic or alicyclic hydrocarbon group containing 6 to 12 carbon atoms, $R_2$ is hydrogen or an aliphatic or alicyclic hydrocarbon group containing up to 12 carbon atoms and n is a number such that the group $(—C_2H_4O—)_n$ comprises 35 to 90% of the molecular weight of the compound of formula (I)

and a compound of formula (II)

$$ROOC—CH_2—\underset{\underset{SO_3X}{|}}{CH}—COOR \quad (II)$$

or mixture thereof, wherein each R is, independently, an aliphatic or alicyclic hydrocarbon group containing 5 to 13 carbon atoms and X is hydrogen, ammonium or an alkali metal cation, and wherein the compounds of formula (I) and formula (II), respectively, are present in a weight ratio in the range 3:1 to 12:1.

2. A composition according to claim 1 wherein the weight ratio of compound of formula (I) to compound of formula (II) is in the range 4.5:1 to 9:1.

3. A composition according to claim 1 which contains no wetting agents other than the compounds of formulae (I) and (II).

4. A composition according to claim 1 wherein the compound of formula (I) has an HLB value in the range 8 to 18.

5. A composition according to claim 4 wherein each R is the same and is $C_{7-9}$ alkyl, $R_1$ is octyl or nonyl and $R_2$ is hydrogen or the same as $R_1$.

6. A composition according to claim 1 wherein, in the compound of formula (I), $R_2$ is hydrogen.

7. A composition according to claim 6 wherein, in the compounds of formulae (I) and (II), $R_1$ and both R's are alkyl groups.

8. A composition according to claim 7 wherein, in the compound of formula (II), both R's are the same.

9. A composition according to claim 8 wherein each R is octyl.

10. A composition according to claim 9 wherein, in the compound of formula (I), $R_1$ is octyl or nonyl.

11. A composition according to claim 10 wherein, in the compound of formula (I), n is a number such that the group $-(C_2H_4O)_n$ comprises about 45 to 90% of the total molecular weight of the compound of formula (I).

12. A composition according to claim 11 wherein, in the compound of formula (I), $R_1$ is octyl and n is 5 to 9 or $R_1$ is nonyl and n is 9.

13. A composition according to claim 11 wherein the weight ratio of compound of formula (I) to compound of formula (II) is in the range 4.5:1 to 9:1.

* * * * *